US010955185B2

(12) United States Patent
Marzi et al.

(10) Patent No.: US 10,955,185 B2
(45) Date of Patent: Mar. 23, 2021

(54) REFRIGERATION APPARATUS AND PROCESS FOR PRODUCING THE SAME

(71) Applicant: Electrolux Appliances Aktiebolag, Stockholm (SE)

(72) Inventors: Stefano Marzi, Porcia (IT); Federico Baldo, Porcia (IT); Jimmy Liessi, Porcia (IT); Augusto Buosi, Porcia (IT)

(73) Assignee: Electrolux Appliances Aktiebolag

( * ) Notice: Subject to any disclaimer, the term of this patent is extended or adjusted under 35 U.S.C. 154(b) by 115 days.

(21) Appl. No.: 16/315,014

(22) PCT Filed: Jul. 6, 2016

(86) PCT No.: PCT/EP2016/066038
§ 371 (c)(1),
(2) Date: Jan. 3, 2019

(87) PCT Pub. No.: WO2018/006957
PCT Pub. Date: Jan. 11, 2018

(65) Prior Publication Data

US 2019/0310008 A1 Oct. 10, 2019

(51) Int. Cl.
*F25D 17/06* (2006.01)

(52) U.S. Cl.
CPC .... *F25D 17/065* (2013.01); *F25D 2317/0653* (2013.01); *F25D 2317/0663* (2013.01)

(58) Field of Classification Search
CPC ..... F25D 17/065; F25D 2317/0653; F25D 2317/0663; F25D 2400/04
(Continued)

(56) References Cited

U.S. PATENT DOCUMENTS 3,466,891 A 9/1969 Maxwell
5,911,750 A 6/1999 Mandel et al.
(Continued)

FOREIGN PATENT DOCUMENTS

DE 10058401 A1 5/2002
DE 102011006807 A1 10/2012
(Continued)

OTHER PUBLICATIONS

European Communication pursuant to Article 94(3) for European Application No. 16 734 725.1, dated Apr. 6, 2020, 9 pages.
(Continued)

*Primary Examiner* — Steve S Tanenbaum
(74) *Attorney, Agent, or Firm* — RatnerPrestia

(57) ABSTRACT

A refrigeration apparatus having an external housing cabinet an inner storage cabinet having a first compartment intended to be cooled at a first temperature, and a second compartment intended to be cooled at a second temperature lower than the first temperature and separated from the first compartment by a partition wall. The first and second compartments and partition wall are defined by a single-piece plastic liner. At least one duct allows air to pass from the first compartment to the second compartment, and at least one fan is provided to force air from the first compartment to the second compartment through duct. At least one evaporator is provided to cool down the air flow before its emission into the second compartment or when it is flowing into the second compartment. A method for producing such a refrigeration apparatus is also provided.

11 Claims, 3 Drawing Sheets

(58) Field of Classification Search
USPC ..... 62/447
See application file for complete search history.

(56) References Cited

U.S. PATENT DOCUMENTS

| | | | |
|---|---|---|---|
| 6,056,383 | A | 5/2000 | Banicevic et al. |
| 6,209,342 | B1 | 4/2001 | Banicevic et al. |
| 2004/0144128 | A1 | 7/2004 | Junge et al. |
| 2007/0001563 | A1 | 1/2007 | Park et al. |
| 2015/0143697 | A1 | 5/2015 | Cook et al. |
| 2016/0069606 | A1 | 3/2016 | Baumann et al. |

FOREIGN PATENT DOCUMENTS

| | | | | |
|---|---|---|---|---|
| EP | 0792666 | A2 | 9/1997 | |
| EP | 2829828 | A1 | 1/2015 | |
| WO | 2014112010 | A1 | 7/2014 | |
| WO | WO-2014112010 | A1 * | 7/2014 | ..... F25D 23/065 |

OTHER PUBLICATIONS

International Search Report and Written Opinion for International Application No. PCT/EP20161066038, dated Mar. 7, 2017—12 pages.
European Communication for European Application No. 16734725.1, dated Nov. 21, 2019, 9 pages.

* cited by examiner

REFRIGERATION APPARATUS AND PROCESS FOR PRODUCING THE SAME

This application is a U.S. National Phase application of PCT International Application No. PCT/EP2016/066038, filed Jul. 6, 2016, which is incorporated by reference herein.

The present invention relates to a refrigeration apparatus, particularly of the household type, and to a process for producing the same.

Currently, household refrigeration apparatuses with two storage compartments at different cooling temperatures are widely known.

In particular, it is known to produce a refrigeration apparatus comprising a cabinet for storing food that comprises an upper compartment at a first temperature and a lower compartment at a second temperature, lower than the first temperature, wherein the two compartments are separated by a horizontal partition that is applied to the cabinet in a movable way.

An example of such a refrigeration apparatus has been described and shown in EP 0792666; in this refrigeration apparatus, a duct arranged on the back wall of the upper compartment extends parallel to said back wall until it opens out into the lower compartment through apertures in the rear region of the horizontal partition. A cooling blower is arranged typically in the upper compartment associated with the upper mouth of the duct, so as to blow air towards the lower compartment; in other known solutions, the blower is arranged in correspondence of the lower mouth of the duct in such a way to suck air from the upper compartment and blow it into the lower compartment. An evaporator is arranged in thermal communication with the internal of the duct, so that air circulated by the cooling blower is cooled by the evaporator before entering the lower compartment; then air enters again, warmer, the upper compartment, through apertures provided in the front region of the horizontal partition and/or through a gap provided between the horizontal partition and the door.

Such a solution has some drawbacks in terms of optimization of the storage space, of complexity of production and assembly, of accumulation of dirt and dust, and of easiness of cleaning.

In fact, a drawback of the known solutions is that the horizontal partition needs to be applied between the compartments by means of guiding and engaging elements. This causes a certain complexity in the production and assembling of the cabinet; moreover, the more pieces are involved in the coupling of the horizontal partition with the cabinet, the more maintenance is needed. Furthermore, it must be taken into account that filth and dust easily tend to accumulate in the areas between the edges of the horizontal partition and the inner walls of the cabinet. These areas can be difficult to be effectively cleaned without removing the horizontal partition.

SUMMARY OF THE INVENTION

The aim of the present invention is to avoid the aforementioned drawbacks, and in particular to provide a refrigeration apparatus, preferably of the household type, that is easier to be produced, assembled and cleaned with respect to the prior art.

A further purpose of the present invention is to provide a refrigeration apparatus, preferably of the household type, that improves the availability of the storage space.

Another purpose of the present invention is providing a method for producing a refrigeration apparatus that achieves the above purposes.

Applicant has found that a two-compartment inner storage cabinet made through a single-piece plastic liner renders the production and the assemble of the refrigeration apparatus simpler. Moreover, such an inner storage cabinet is very easy to clean, not having coupling areas wherein filth or dust tends to accumulate.

In particular, a refrigeration apparatus comprising accomplishes the above aim and purposes:

- an external housing cabinet;
- an inner storage cabinet housed in said external housing cabinet and having a first compartment intended to be cooled at a first temperature, and a second compartment intended to be cooled at a second temperature lower than said first temperature, said first and second compartments having respective accesses for loading/unloading a product to be cooled, and being separated from one another by a partition wall, said first and second compartments and said partition wall being defined by a single-piece plastic liner, said inner storage cabinet being provided with at least one duct that allows the passage of air from said first compartment to said second compartment;
- at least one air passage allowing the passage of air from said second compartment to said first compartment;
- at least one fan arranged to generate a forced air flow circulating from said first compartment to said second compartment through said at least one duct, and from said second compartment to said first compartment through said at least one air passage;
- at least one evaporator arranged to cool down the forced air flow before its emission into said second compartment, or when it is flowing into said second compartment.

Preferably, the first compartment has at least one first aperture that acts as an intake mouth of said at least one duct and said second compartment has at least one second aperture that acts as an outflow mouth of said at least one duct, said at least one duct comprising at least one connector element applied to the inner storage cabinet so as to fluidly connect said first and second apertures one another.

More preferably, the at least one connector element comprises at least one internal passage and is restrained to said inner storage cabinet, so that said at least one internal passage fluidly connects said first aperture and said second aperture.

Even more preferably, the at least one connector element has a rear portion that abuts against a back wall of said inner storage cabinet externally to said first and second compartments.

According to an advantageous embodiment, the connector element is provided with reinforcing elements for increasing the stiffness of said at least one connector element.

According to a further advantageous embodiment, said first compartment is an upper compartment and said second compartment is a lower compartment.

In a preferred embodiment, the inner storage cabinet comprises a conduit that is associated with the back wall of said inner storage cabinet and comprises said at least one duct, said duct comprising an inlet fluidly connected to the internal of said first compartment, and an outlet, fluidly connected to the internal of said second compartment.

Preferably, the at least one fan is arranged in an upper portion of said conduit or in a lower portion of said conduit.

Advantageously, the at least one evaporator is arranged in a lower position of said conduit, in proximity to the outlet of said conduit.

According to a further advantageous embodiment, the at least one evaporator is arranged outside said conduit.

Preferably, the refrigeration apparatus comprises at least one door associated with said external housing cabinet for closing the accesses of said first and second compartments and said at least one air passage comprises a gap between said partition wall and said door.

The invention is further related to a process for producing a refrigeration apparatus comprising the steps of:

- producing through a thermoforming process a single-piece plastic liner in which a first compartment and a second compartment separated from one another by a partition wall are defined;
- making at least one first aperture in the first compartment and at east one second aperture in the second compartment;
- applying at least one connector element to said single-piece plastic liner, so as to fluidly connect said first aperture and said second aperture with one another, thus making at least one duct allowing the passage of air from the first compartment to the second compartment.

According to an advantageous embodiment of the inventive method, the first aperture and the second aperture are obtained by making cuttings in said single-piece plastic liner.

According to a further advantageous embodiment of the inventive method, the latter further comprises the steps of:

- inserting said single-piece plastic liner and said at least one connector element applied thereto into an external cabinet;
- inserting thermo-insulating material between said external cabinet and said single-piece plastic liner.

According to another advantageous embodiment of the inventive method, the latter comprises, prior to the thereto-insulating material insertion, the step of installing and mounting a plurality of functional elements and their connections to said single-piece plastic liner and/or to said external cabinet.

BRIEF DESCRIPTION OF THE DRAWINGS

The characteristics and advantages of a refrigeration apparatus and of a method for producing the same according to the present invention will become clearer from the following description, given as an example and not for limiting purposes, referring to the attached schematic drawings in which.

DETAILED DESCRIPTION OF EXEMPLARY EMBODIMENTS

Figure 1:
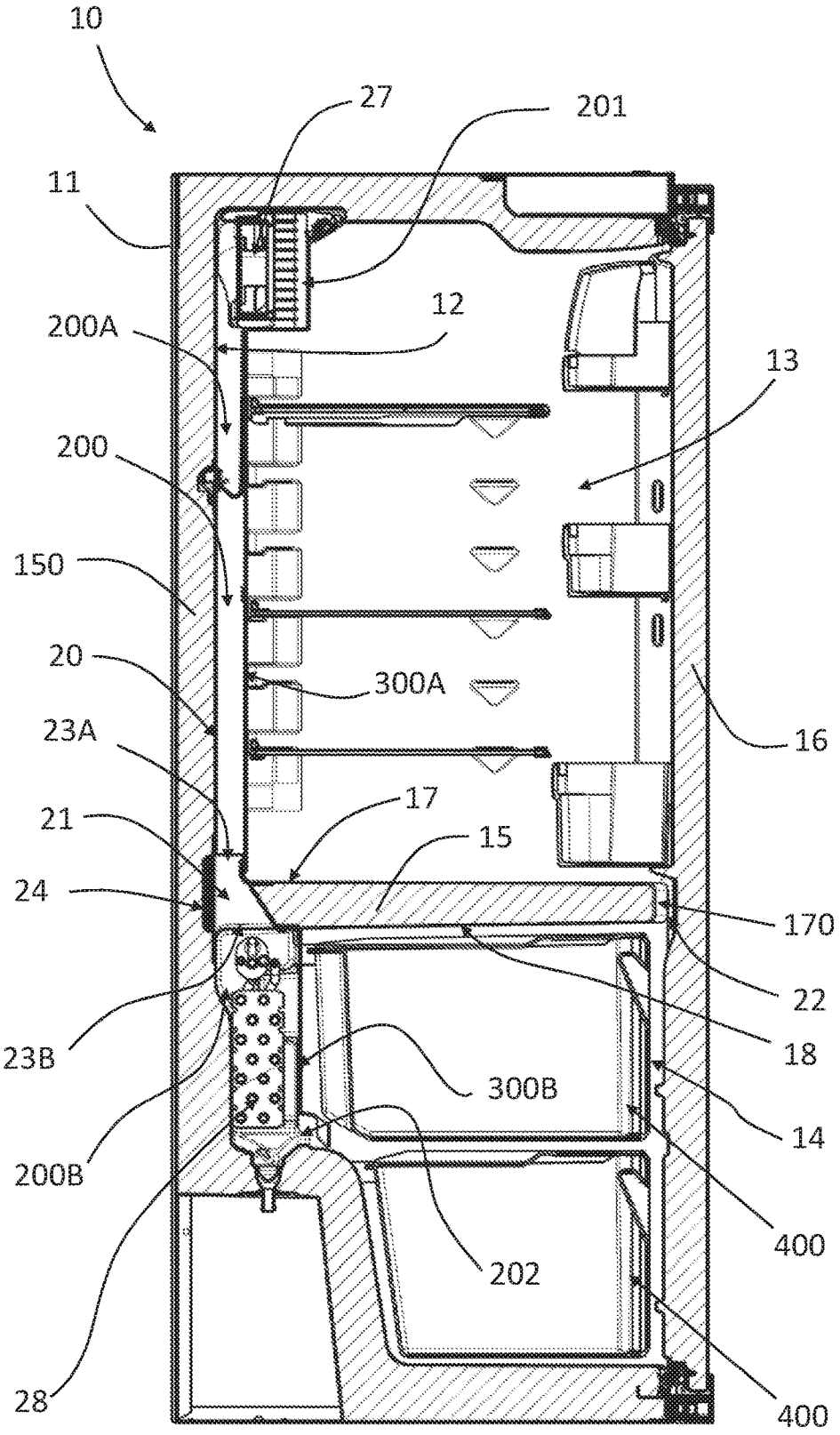
FIG. 1 is a cross-sectional side view, with some parts removed for clarity, of a refrigeration apparatus according to the present invention.
Figure 3:
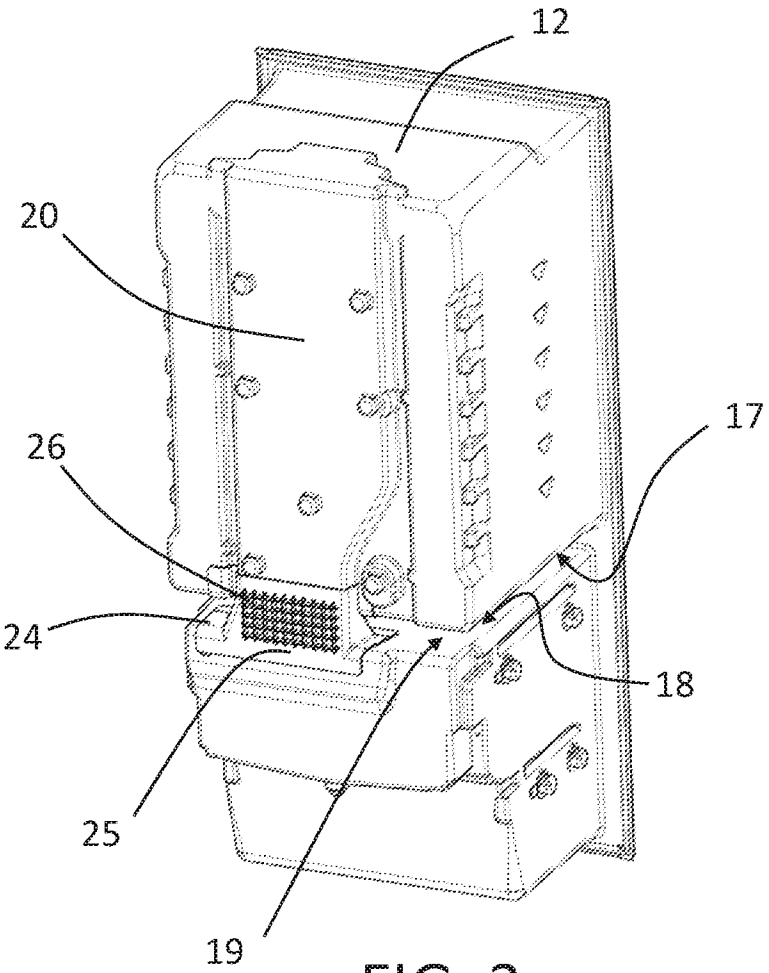
FIG. 3 is a rear perspective view of the single-piece plastic liner of FIG. 2 during a second phase of the production process.
Figure 2:
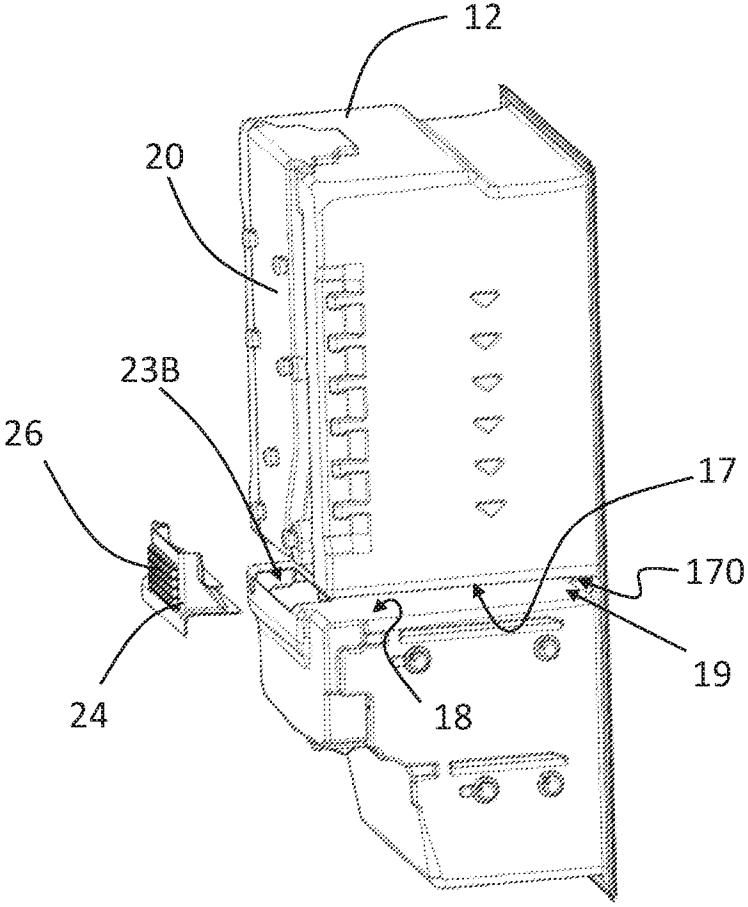
FIG. 2 is a rear perspective view of the single-piece plastic liner of the refrigeration apparatus of FIG. 1 during a first phase of the production process.
Figure 5:
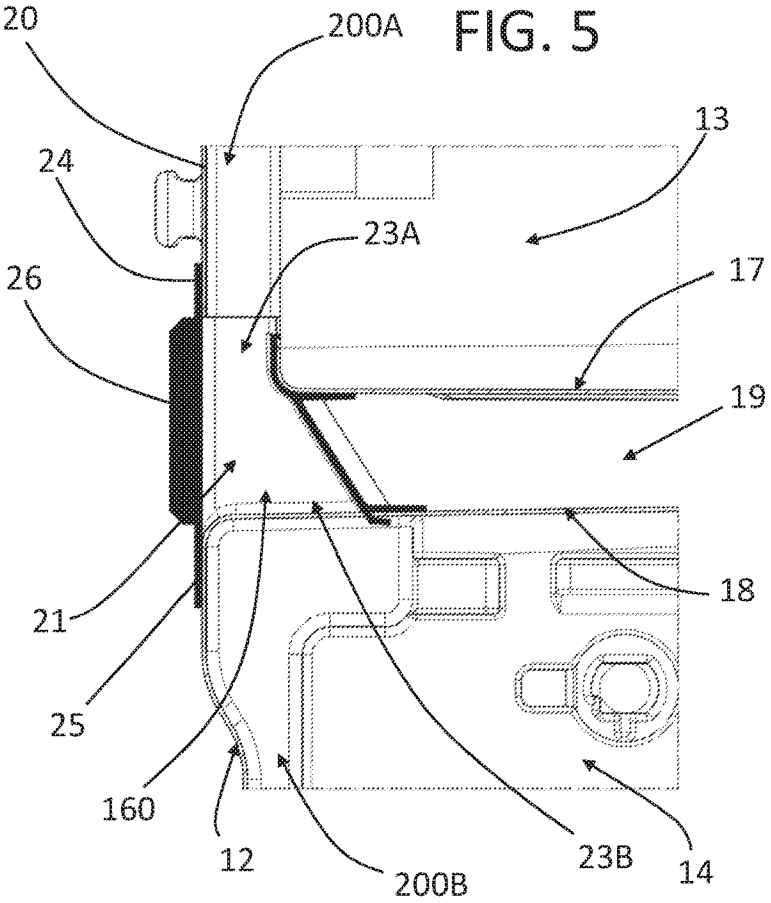
FIG. 5 is cross sectional side view of a detail of the refrigerator according to the invention during the same second phase of the production process illustrated in FIG. 3.
Figure 4:
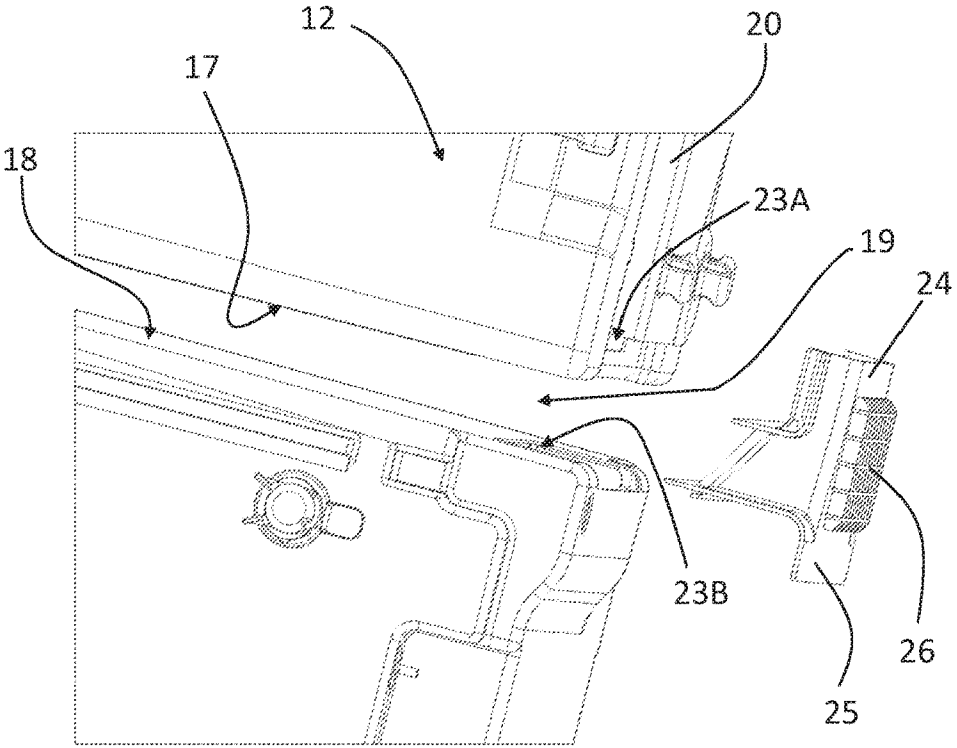
FIG. 4 is a view of a detail of the refrigerator according to the invention during the same first phase of the production process illustrated in FIG. 2.

With reference to FIG. 1, a refrigeration apparatus 10 according to the present invention is shown.

Such a refrigeration apparatus 10 comprises an external housing cabinet 11 and an inner storage cabinet 12 (called also inner liner, or plastic liner) housed in the external housing cabinet 11.

A thermo-insulating material 150, for example of the foam-like type, can be inserted between the external housing cabinet 11 and the inner storage cabinet 12.

The inner storage cabinet 12 has a first compartment 13 and a second compartment 14, which have respective accesses for loading/unloading a product to be cooled, and that are separated from one another by a partition wall 15. Preferably, but not necessarily, the first and/or the second compartments 13, 14 can contain one or more drawers 400, adapted for storing products to be cooled down.

The refrigeration apparatus 10 comprises at least one door 16, associated with the external housing cabinet 11 for closing/opening the accesses to the compartments 13, 14. The door 16 can be preferably hinged directly or indirectly to at least one side of the external cabinet 11. In the advantageous embodiment illustrated in attached drawings, a single door 16 closes both the first compartment 13 and the second compartment 14; in a further possible advantageous embodiment, not illustrated, there can be a dedicated door for each compartment 13, 14.

The first compartment 13 is intended to be cooled at a first temperature, whereas the second compartment 14 is intended to be cooled at a second temperature, lower than the first temperature.

Preferably, the second temperature is equal to approximately 0° C.

Preferably, but not necessarily, as in the illustrated embodiment, the first compartment 13 is an upper compartment and the second compartment 14 is a lower compartment. In this advantageous embodiment, therefore, the lower compartment 14 is intended to be cooler than the upper compartment 13. Alternatively, in a further advantageous embodiment, the first compartment 13 can also be the lower compartment, whereas the second compartment 14 can be the upper compartment.

In the following, for the sake of clarity, reference is made to the case in which the first compartment 13 is the upper compartment and the second compartment 14 is the lower compartment, however all of the expressed arguments relating thereto can be applied if the first compartment 13 is the lower compartment and the second compartment 14 is the upper compartment.

According to the present invention, the compartments 13, 14 and the partition wall 15 are defined by a single-piece (called also single-body) plastic liner; in other words, a single plastic liner, preferably obtained by a single sheet of plastics, opportunely thermo-formed, defines both the first and second compartments and the partition wall 15 dividing these compartments one another.

As illustrated in the enclosed figures, the partition wall 15 can have two opposite portions 17, 18 joined to each other at one end 170 oriented towards the door 16 (when the latter is closed), and spaced to each other so as to define a gap 19 therebetween, opened at least towards the back wall 20 of the inner storage cabinet 12.

Advantageously, the inner storage cabinet 12 is provided with at least one duct 21 that allows the passage of air from the first compartment 13 to the second compartment 14.

Advantageously, the refrigeration apparatus 10 comprises at least one air passage 22 allowing the passage of air from the second compartment 14 to the first compartment 13.

The at least one air passage 22 preferably comprises a gap defined between the partition wall 15 and the door 16 (when the latter is closed). In a further advantageous embodiment, not illustrated, the at least one air passage can comprise a pass-through aperture made through the partition wall 15.

Preferably, the at least one duct 21 is defined by at least two apertures 23A, 23B, obtained respectively in the first compartment 13 and in the second compartment 14; these two apertures 23A and 23B are advantageously fluidly connected one another through at least one connector element 24, advantageously fixed to the inner storage cabinet 12.

In the advantageous embodiment illustrated in attached figures, the first aperture 23A of the first compartment 13 acts as an intake mouth of the at least one duct 21, and at least one second aperture 23B of the second compartment 14 acts as an outflow mouth of the at least one duct 21.

In the advantageous embodiment illustrated in attached drawings, the apertures 23A and 23B are made on two opposite faces of the partition wall 15 close to the back wall 20 of the inner storage cabinet 11, so that the two aperture 23A and 23B face one another. However, the apertures 23 can be made at any portion of the single piece plastic liner 12, not necessarily one facing the other. Consequently, the connector element 24 can advantageously be a tubular flexible element or a group of tubular elements adapted to create the duct 21.

Advantageously, the connector element 24 comprises at least one internal passage 160 and is restrained to the inner storage cabinet 12, so that the at least one internal passage results to be placed between the first aperture 23A and the second aperture 23B.

In the illustrated embodiment, the at least one connector element 24 has a rear portion 25 that abuts against the back wall 20 of the inner storage cabinet 12, externally to the compartments 13, 14.

Advantageously, the connector element 24 partially closes the opening of the channel 19 defined by the opposite portions 17, 18 of the partition wall 15, and the rear portion 25 advantageously at least partially overlaps the back wall 20 of the inner storage cabinet 12. A seal between the at least one connector element 24 and the inner storage cabinet 12 is preferably provided. In this way the at least one duct 21 is insulated from the penetration of the thereto-insulating material during its pouring in the gap between the external housing cabinet 11 and an inner storage cabinet 12.

Preferably the rear portion 25 is provided with reinforcing elements 26 for increasing the stiffness of the at connector element 24. For example, as in the illustrated embodiment, such reinforcing elements 26 can be made for example as crossed ribs arranged on the back of the rear portion 25.

The refrigeration apparatus 10 advantageously comprises a conduit 200 associated with the back wall 20 of the inner storage cabinet 12, which conduit 200 comprises said at least one duct 21. Advantageously the inlet 201 of the duct 200 is fluidly connected to the internal of the first compartment 13, and the outlet 202 of the duct 200 is fluidly connected to the internal of the second compartment 14.

Advantageously, the conduit 200 comprises, in addition to said at least one duct 21, at least a first conduit part 200A, and at least a second conduit part 200B, fluidly connected, respectively, upstream and downstream to said at least one duct 21.

Advantageously, the first conduit part 200A is at least partially defined by the back wall 20 of the inner storage cabinet 12 and by one or more first cover panels 300A, coupled to the back wall 20 internally to the inner storage cabinet 12, preferably within the first compartment 13, in such a way that a gap is defined between the back wall 20 and the first cover panel 300A, this gap defining the first conduit part 200A.

Advantageously, the second conduit part 200B is at least partially defined by the back wall 20 of the inner storage cabinet 12 and by one or more second cover panels 300B, coupled to the back wall 20 internally to the inner storage cabinet 12, preferably within the second compartment 14, in such a way that a gap is defined between the back wall 20 and the second cover panel 300B, this gap defining the second conduit part 200B.

The refrigeration apparatus 10 also advantageously comprises at least one fan 27 arranged to generate a forced air flow from the first compartment 13 to the second compartment 14 through the at least one duct 21. Advantageously the fan 27 is positioned within the conduit 200.

Preferably, the at least one fan 27 is arranged in an upper position of the conduit 200, more preferably within the first conduit part 200A, and therefore within the first compartment 13, so as to suck air from the internal of the first compartment 13 through the inlet 201, circulating this air through the duct 21 and the second conduit part 200B, and emitting it into the second compartment 14 via the outlet 202. In a further advantageous embodiment, not illustrated the fan 27 can be positioned in other positions within the conduit 200, for example in the second conduit part 200B, preferably in proximity to the outlet 202.

The refrigeration apparatus 10 advantageously comprises at least one evaporator 28 arranged to be in thermal exchange communication with the air flow circulated by the fan 27 and to cool down this air before the latter is emitted into the second compartment 14 or during its flowing in the second compartment 14.

By cooling down air flow entering or flowing through the second compartment 14, the evaporator 28 has the effect of cooling down the second compartment 14; when this air flow exits the second compartment 14 via the passage 22, it has already absorbed some heat from the walls of the second compartment 14, the drawers 400 (if any) and the products (if any) contained therein, so its temperature has increased and therefore it can cool down the first compartment 13 to a temperature higher than the second compartment 14.

The at least one evaporator 28 can be advantageously arranged inside or outside the inner storage cabinet 12. Preferably, the evaporator 28 is positioned within the second conduit part 200B.

In the illustrated embodiment, the at least one evaporator 28 is associated with the second compartment 14 and cools the air forced down by the at least one fan 27. The cooled air, then, passes through the second compartment 14 and goes up through the air passage 22 into the first compartment 13.

The process for producing a refrigeration apparatus according to the present invention comprises the steps of producing, through a thermoforming process, a single-piece (or one-piece, or single-body) plastic liner 12 in which the first compartment 13 and the second compartment 14 separated one another by the partition wall 15 are defined. It is underlined that after the thermoforming of the plastic liner 12 other elements (e.g. electric or electronic devices, like sensors, electronic boards, etc.), can be fixed to the plastic liner before completing the assembly of the refrigeration apparatus 10. Then, the at least one first aperture 23A in the first compartment 13 and the at least one second aperture 23B in the second compartment 14 are made, preferably by making cuttings in the single-piece plastic liner 12. In a further advantageous embodiment, the first and second apertures 23A and 23B can be obtained directly during the thermoforming process of the liner 12, for example by suitably shaping the thermoforming mold.

Then, the at least one connector element 24 is applied to the single-piece plastic liner 12, so as to fluidly connect the first 23A and second 23B apertures one another, thus obtaining the at least one duct 21, Advantageously the process comprises the step of sealing the at least one connector element 24 applied to the single-piece plastic liner 12.

After the sealing, or however after the application of the at least one connector element 24 to the single-piece plastic liner 12, the single-piece plastic liner 12 is inserted into the external housing cabinet 11 and then the thereto-insulating material is inserted between the external cabinet 11 and the single-piece plastic liner 12. Thermo insulating material 150, for example a thereto insulating foam, advantageously fills the gap between the single-piece plastic liner 12 and the external housing cabinet 11; the connector element 24 prevents foam to enter the first and second apertures 23A, 23B.

Before the thereto-insulating material insertion, preferably also before associating the single piece plastic liner 12 to the external housing cabinet 11, one or more functional elements and their connections to the single-piece plastic liner and/or to the external cabinet are installed and mounted. The functional elements may comprise, for example, the at least one fan 27 and the at least one evaporator 28, as well as lamps, sensors and so on.

From the above description, the characteristics of the refrigeration apparatus and of the process for producing the same, subject of the present invention, are clear, as well as the relative advantages are clear.

Finally, it is clear that the refrigeration apparatus and the process for producing the same thus conceived are susceptible of numerous modifications and variants, all falling within the invention; in addition, all the details can be substituted by technically equivalent elements. In practice, the materials used, as well as the size, can be of any type in accordance with the technical needs.

The invention claimed is:

1. A refrigeration apparatus comprising:

an external housing cabinet;

an inner storage cabinet housed in the external housing cabinet and having a first compartment intended to be cooled at a first temperature, and a second compartment intended to be cooled at a second temperature lower than the first temperature, the first and second compartments having respective accesses for loading/unloading a product to be cooled, and being separated from one another by a partition wall, the first and second compartments and the partition wall being defined by a single-piece plastic liner, the inner storage cabinet being provided with at least one duct configured to allow air to pass from the first compartment to the second compartment;

at least one air passage configured to allow air to pass from the second compartment to the first compartment;

at least one fan configured to generate a forced air flow circulating from the first compartment to the second compartment through the at least one duct, and from the second compartment to the first compartment through the at least one air passage;

at least one evaporator configured to cool down the forced air flow before its emission into the second compartment, or when it is flowing into the second compartment; and at least one door associated with the external housing cabinet for closing the accesses of the first compartment and the second compartment;

wherein the at least one air passage comprises a gap between the partition wall and the at least one door.

2. The refrigeration apparatus according to claim 1, wherein the first compartment has at least one first aperture comprising an intake mouth of the at least one duct and the second compartment has at least one second aperture comprising an outflow mouth of the at least one duct, and the at least one duct comprises at least one connector element attached to the inner storage cabinet to fluidly connect the first aperture to the second aperture.

3. The refrigeration apparatus according to claim 2, wherein the at least one connector element comprises at least one internal passage that is attached to the inner storage cabinet, such that the at least one internal passage fluidly connects the first aperture and the second aperture.

4. The refrigeration apparatus according to claim 3, wherein the at least one connector element has a rear portion that abuts against a back wall of the inner storage cabinet externally to the first and second compartments.

5. The refrigeration apparatus according to claim 2, wherein the at least one connector element comprises reinforcing elements configured to increase the stiffness of the at least one connector element.

6. The refrigeration apparatus according to claim 1, wherein the first compartment is located above the second compartment when the refrigeration apparatus is in a use position.

7. The refrigeration apparatus according to claim 1, wherein the at least one duct comprises a conduit having a first portion extending along a back wall of the first compartment and having an inlet fluidly connected to an internal space of the first compartment, and a second portion extending along a back wall of the second compartment and having an outlet fluidly connected to an internal space of the second compartment.

8. The refrigeration apparatus of claim 7, wherein the at least one duct further comprises a connector formed separately from the single-piece plastic liner and fluidly connected between the first portion of the conduit and the second portion of the conduit.

9. The refrigeration apparatus according to claim 7, wherein the at least one fan is arranged in the first portion of the conduit, or in the second portion of the conduit.

10. The refrigeration apparatus according to claim 7, wherein the at least one evaporator is arranged in the second portion of the conduit, in proximity to the outlet of the second portion of the conduit.

11. The refrigeration apparatus according to claim 7, wherein the at least one evaporator is arranged outside the conduit.

* * * * *